US007641138B1

(12) United States Patent
Lo

(10) Patent No.: US 7,641,138 B1
(45) Date of Patent: Jan. 5, 2010

(54) AUXILIARY UNIT OF PAPER SHREDDER CUTTING TOOLS

(76) Inventor: Emily Lo, No. 18, 20 Lane, Hsin Feng Street, Hsin Chuang City, Taipei Shien (TW)

( * ) Notice: Subject to any disclaimer, the term of this patent is extended or adjusted under 35 U.S.C. 154(b) by 0 days.

(21) Appl. No.: 12/082,868

(22) Filed: Apr. 14, 2008

(51) Int. Cl.
*B02C 7/04* (2006.01)
*B02C 13/20* (2006.01)

(52) U.S. Cl. ..... 241/236

(58) Field of Classification Search ..... 241/236, 241/100, 286
See application file for complete search history.

(56) References Cited

U.S. PATENT DOCUMENTS 2,202,843 A * 6/1940 Edwards ..... 83/68
3,724,766 A * 4/1973 Bosland ..... 241/100
4,260,115 A * 4/1981 Hatanaka ..... 241/236
4,489,897 A * 12/1984 Turner et al. ..... 241/167
4,562,971 A * 1/1986 Schwelling ..... 241/236
4,688,730 A * 8/1987 Dahle ..... 241/166
4,690,340 A * 9/1987 Hatanaka ..... 241/236
4,693,428 A * 9/1987 Raterman et al. ..... 241/167
5,295,633 A * 3/1994 Kimbro et al. ..... 241/166
5,636,801 A * 6/1997 Kroger ..... 241/167
5,826,809 A * 10/1998 Kroger ..... 241/167
5,829,697 A * 11/1998 Kroger ..... 241/236

* cited by examiner

*Primary Examiner*—Bena Miller
(74) *Attorney, Agent, or Firm*—Pro-Techter Int'l Services

(57) ABSTRACT

An auxiliary unit of paper shredder cutting tools is installed on cutting tools of a paper shredder. The auxiliary unit is formed by two L-shape plates located between two neighboring blades, an arc-shape hole at an end of each L-shape plate is hooked on a cutting bar of the cutting tool, and a through-hole of each L-shape plate provides for a support rod to be transfixed, so as to stably fix paper guides, the cutting bars and the blades. Therefore, the paper guides, the cutting bars and the blades can be prevented from getting loose or stretched open to damage the paper shredder or result in noise or even an imperfect shredding effect.

2 Claims, 2 Drawing Sheets

AUXILIARY UNIT OF PAPER SHREDDER CUTTING TOOLS

BACKGROUND OF THE INVENTION a) Field of the Invention

The present invention relates to an auxiliary unit of paper shredder cutting tools, and more particularly to an auxiliary unit which is assembled by two L-shape plates and is installed in cutting tools of a paper shredder, to prevent paper guides, cutting bars and blades from getting loose or being stretched open, thereby avoiding the paper shredder to be damaged or result in noise or even an imperfect shredding effect when shredding paper.

b) Description of the Prior Art

An interior of a paper entrance of a conventional ordinary paper shredder is provided with two rows of cutting tools, with plastic paper guides being crossed over between neighboring blades, and arc-shape holes at bottom ends of the paper guides being hooked on long support rods. Heat will be generated by the paper shredder during a paper shredding process, and the paper guides, cutting bars and blades will be loosen or stretched open upon being heated, allowing the paper shredder to be damaged or to result in vibration noise or even an imperfect shredding effect.

SUMMARY OF THE INVENTION

Accordingly, the primary object of the present invention is to provide an auxiliary unit of paper shredder cutting tools, wherein the auxiliary unit, which is formed by locking two L-shape plates, provides for support rods of the cutting tools to transfix, with a hole at an end of the L-shape plate hooking a cutting bar of the cutting tool to stably fix a paper guide, the cutting bar and a blade, thereby preventing the paper shredder from being damaged, resulting in vibration noise or even an imperfect shredding effect due to that the paper guides, cutting bars and blades are loosen or stretched open when shredding paper.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
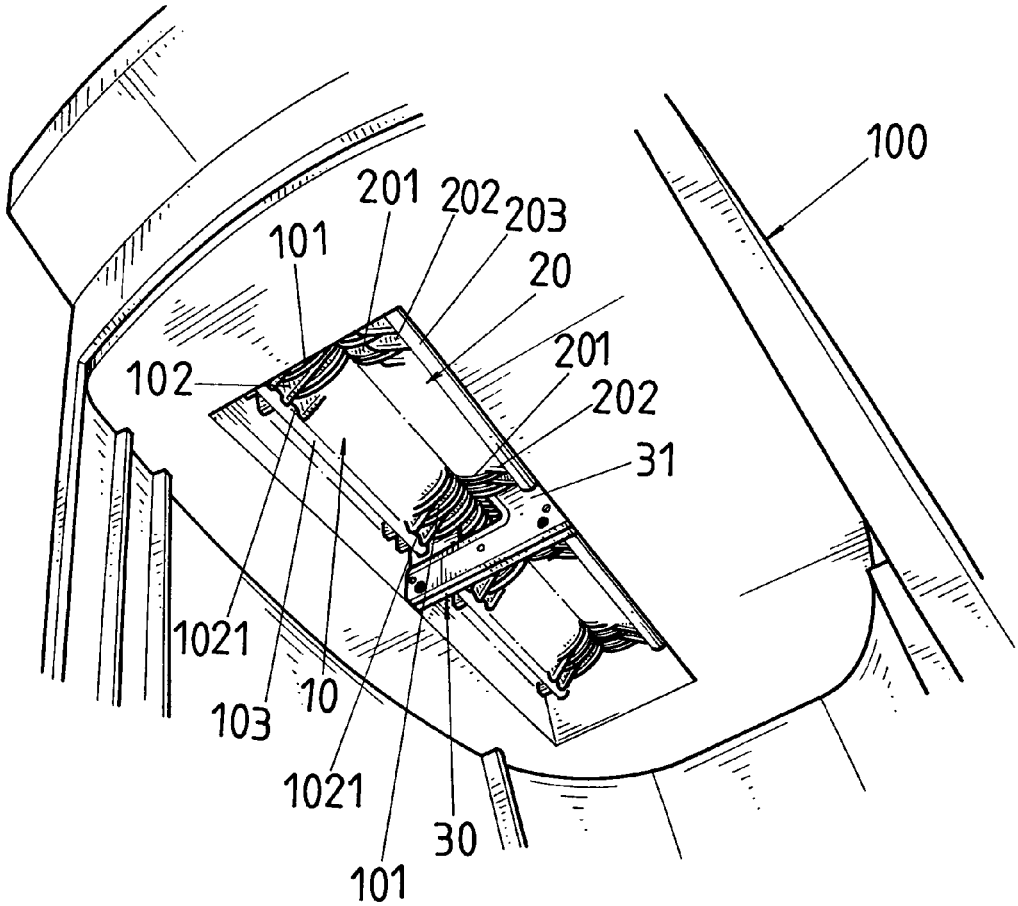
FIG. 1 shows a schematic view of a part of structures of a paper shredder of the present invention.

Referring to FIG. 1, an interior of a paper entrance at a top end of a paper shredder 100 of the present invention is provided with two rows of cutting tools 10, 20. Each row of the cutting tools 10, 20 is provided respectively with a plurality of blades 101, 201, with paper guides 102, 202 being crossed over between two neighboring blades 101, 201, and an arc-shape hole 1021 at a bottom end of each of the paper guides 102, 202 being hooked respectively on a long support rod 103, 203.

Figure 2:
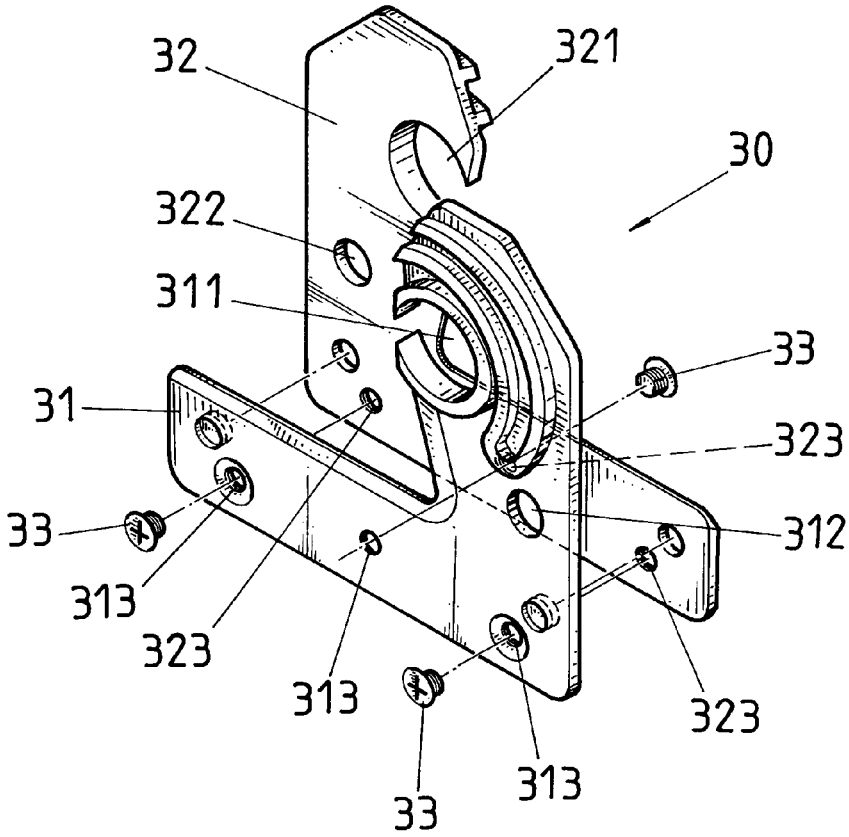
FIG. 2 shows an exploded view of an auxiliary unit of a paper shredder of the present invention.
Figure 3:
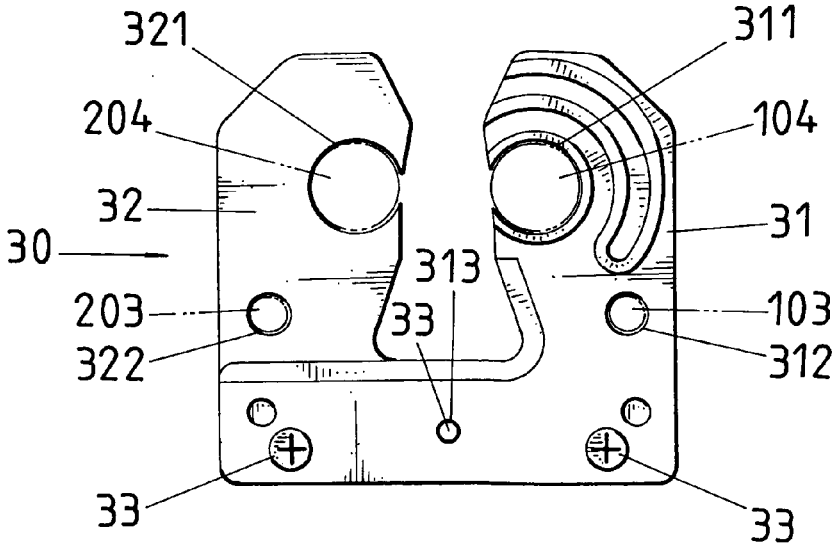
FIG. 3 shows a plan view of an auxiliary unit of a paper shredder of the present invention, after being assembled.

Two support rods 103, 203 of the cutting tools 10, 20 are transfixed with an auxiliary unit 30, referring to FIGS. 2 and 3. The auxiliary unit 30 is formed by two L-shape plates 31, 32 which are located between the neighboring blades 101,201 respectively, at a middle portion of the cutters, and are reversed left-to-right with respect to each other. An end of each of the L-shape plates 31, 32 is provided respectively with an arc-shape hole 311, 321 which is hooked respectively on a cutting bar 104, 204 of the cutting tool 10, 20 (as shown in FIG. 3). The two L-shape plates 31, 32 are disposed respectively with through-holes 312, 322 for transfixing with a respective one of the support rods 103, 203 of the cutting tools 10, 20, and a bottom of each of the L-shape plates 31, 32 is provided with at least one screw-hole 313, 323, such that when the two L-shape plates 31, 32 are abutted, the L-shape plates 31, 32 can be locked by transfixing screws 33 into the screw-holes 313,323.

As will be apparent from the foregoing, the paper shredder 100 of the present invention is provided with the auxiliary unit 30 to hook the cutting bars 104, 204 of the cutting tools 10, 20, and the auxiliary unit 30 engages the support rods 103, 203 to stably fix the paper guides 102, 202, such that when shredding paper, the paper guides 102, 202, the cutting bars 104, 204 and the blades 101, 201 will not get loose or stretched open easily, thereby preventing the paper shredder 100 from being damaged or resulting in noise or even an imperfect shredding effect.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An auxiliary unit for a pair of paper shredder cutting tools which are positioned inside a paper entrance of a paper shredder and have interleaving blades alternatingly mounted on cutting bars with paper guides separating neighboring blades with an arc-shaped hole at a bottom end of each of the paper guides being hooked on one of two long support rods, comprising two L-shape plates, with an inner surface of an end of each L-shape plate being provided with an arc-shape hole hooked one of the cutting bars of the cutting tool, and a through-hole on each L-shape plate being received onto one of the support rods, thereby transfixing said one of the support rods and said one of the cutting bars of the cutting tool;

wherein said two L-shape plates are mounted abutting and reversed left-to-right with respect to each other, and located between neighboring blades of said cutters at a middle portion thereof.

2. The auxiliary unit paper shredder cutting tools according to claim 1, wherein each L-shape plate of the auxiliary unit of the cutting tool is provided with at least one screw-hole, such that when the two L-shape plates are abutted, the L-shape plates are locked by transfixing screws into the screw-holes.

* * * * *